United States Patent [19]

Joswig

[11] 4,134,499

[45] Jan. 16, 1979

[54] TOOL HOLDER

[75] Inventor: Siegfried Joswig, Kausen, Fed. Rep. of Germany

[73] Assignee: Wolf-Gerate GmbH, Fed. Rep. of Germany

[21] Appl. No.: 724,978

[22] Filed: Sep. 20, 1976

[30] Foreign Application Priority Data

Sep. 26, 1975 [DE] Fed. Rep. of Germany ... 7530561[U]
Apr. 12, 1976 [DE] Fed. Rep. of Germany ... 7611478[U]

[51] Int. Cl.[2] ..... A47G 29/08; A44B 21/00

[52] U.S. Cl. ..... 211/66; 24/244; 211/60 T; 248/316 F

[58] Field of Search ..... 211/60, 65, 66, 68; 248/110–113, 316 F; 24/244

[56] References Cited

U.S. PATENT DOCUMENTS

| | | | |
|---|---|---|---|
| 867,199 | 9/1907 | Jack | 24/244 |
| 1,366,324 | 1/1921 | Newquist | 248/316 F X |
| 1,509,407 | 9/1924 | MacQuarrie | 211/35 |
| 1,674,581 | 6/1928 | Webb | 24/244 |
| 1,908,554 | 5/1933 | Rauchat | 24/244 |
| 2,231,883 | 2/1941 | Caceivio | 24/244 |
| 3,071,252 | 1/1963 | Hanschar | 211/60 T |
| 3,422,960 | 1/1969 | Ell et al. | 211/60 T |
| 3,672,619 | 6/1972 | Bowen | 248/316 F X |

FOREIGN PATENT DOCUMENTS

| | | | |
|---|---|---|---|
| 725343 | 2/1932 | France | 24/244 |
| 196315 | 3/1938 | Switzerland | 24/244 |
| 769425 | 3/1957 | United Kingdom | 248/316 F |

*Primary Examiner*—Roy D. Frazier
*Assistant Examiner*—Terrell P. Lewis
*Attorney, Agent, or Firm*—Ostrolenk, Faber, Gerb & Soffen

[57] ABSTRACT

A holder for a plurality of tools having shafts or handles; a plurality of notches, each for a handle, with each notch having two side walls and at least one of the walls being sloped, and a gripping roller resting against the sloped wall and engaging the tool shaft or handle by wedging against it.

11 Claims, 14 Drawing Figures

Fig.9
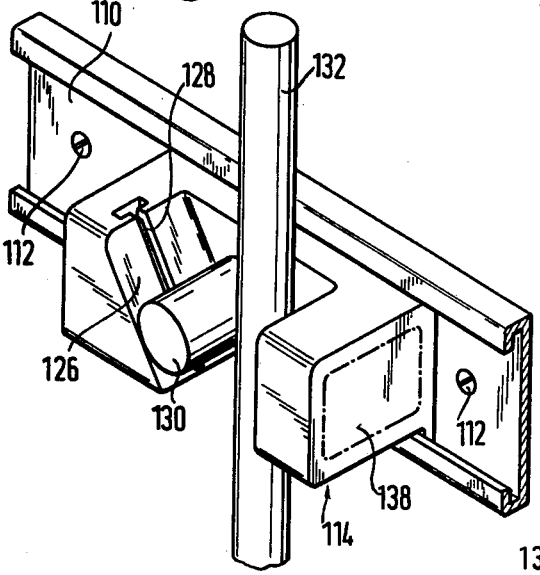
Fig.10
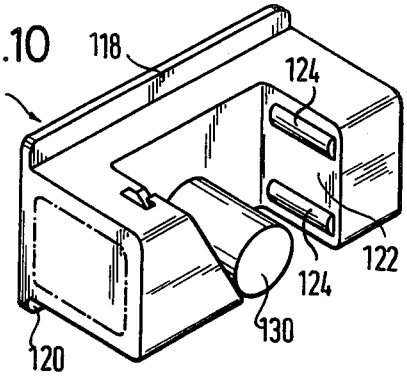
Fig.13
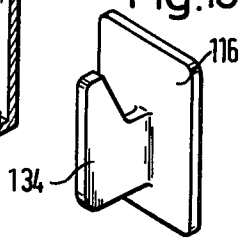
Fig.14
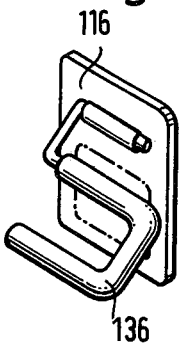
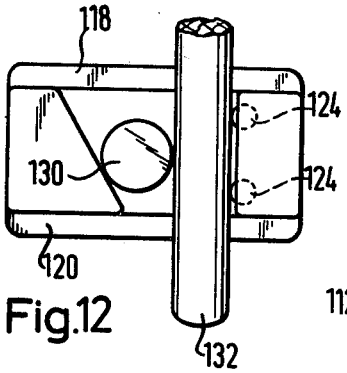
Fig.12
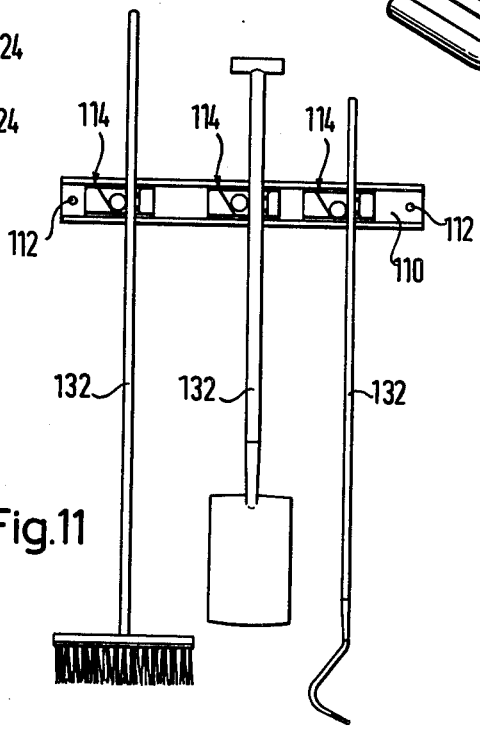
Fig.11

TOOL HOLDER

This invention relates to a holder for domestic and garden tools, more especially for tools having a long shaft. The storage of domestic and garden tools in such a way that they are always readily accessible involves difficulties, especially when it is intended to store several such tools, differing from one another both in type and also in the shape and diameter of their shafts, not only in cupboards, but also in cellars or garages.

Accordingly, the object of the present invention is to provide a tool holder which is able to accommodate tools differing from one another in shape and size in a compact, orderly and readily accessible manner in such a way that they can be conveniently introduced and removed whilst, at the same time, being reliably prevented from accidentally dropping out.

According to the invention, this object is achieved by virtue of the fact that the tool holder comprises a gripping device for the tool shaft or handle which is automatically activated by the weight of the tool and which consists of two opposite walls between which the shaft is intended to be introduced and at least one of which has a bevelled surface with a gripping roller which comes into friction-locking contact with the shaft by wedge effect.

A U-shaped tool holder such as this may be designed for a single tool with a single U-shaped holder. Alternatively, it is possible to produce holding blocks which comprise several such holders adjacent one another. According to another aspect of the invention, the holders may be individually produced and provided with suitable connecting means, for example plug-and-socket connections, which enable any number of individual holders to be joined together in a row.

By virtue of the inclined surface along which the roller travels, shafts or even tool handles differing in diameter may be gripped because the roller is able to grip the shaft at any point along its sloping path.

According to another aspect of the invention, the rear wall of the holder comprises upwardly and downwardly projecting flanges which are adapted for insertion into a guide rail of C-shaped profile. This rail, which is preferably made of a plastics material, may be used in any length and, to this end, may be manufactured in different standard lengths which may readily be adapted to suit individual requirements by cutting the rails to the appropriate length.

Any number of the tool holders may be inserted into the rail adjacent one another and, in this connection, may either be joined together in a row without any intervals in between or may be arranged at any intervals from one another, depending upon the type of tools to be accommodated.

Accordingly, the tool holder according to the invention enables a whole number of tools to be accommodated economically in terms of space, eliminating the inconvenience of leaving tools standing on the floor with their shafts or heads, instead they may be arranged to hang freely with the tool heads below or above the tool holder or even alternately above and below the tool holder.

In cases where it is not possible or not desired to introduce the shaft from below, it may also be readily introduced from the side by lifting the roller slightly with the finger. This is important for example in the case of a broom cupboard or the like. The roller may be lifted and the shaft introduced in a single operation carried out with one hand.

Embodiments of the invention are described by way of example in the following with reference to the accompanying drawings, wherein:

FIG. 9 is a perspective elevation of another embodiment in the form of a holder introduced into a rail section.

FIG. 10 is a perspective view of the holder shown in FIG. 9 as an individual holder.

FIG. 11 is an elevation of a guide rail with three gripping devices inserted therein.

FIG. 12 is an elevation of a gripping device with a shaft inserted therein.

FIGS. 13 and 14 show slide-in elements designed for insertion into the guide rail holding the gripping device illustrated in FIG. 9.

Figure 1:
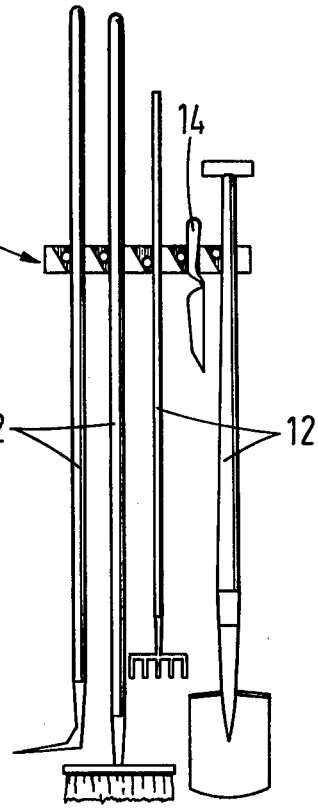
FIG. 1 is an elevation of a tool holder accommodating five different tools.

As can be seen from FIG. 1, different types of tools 12 can be accommodated with their shafts 12 or handles 14 in a wall-mounted tool holder 10 in such a way that their tool heads are situated at different levels so that they do not overlap one another and, accordingly, may conveniently be individually removed.

Figure 2:
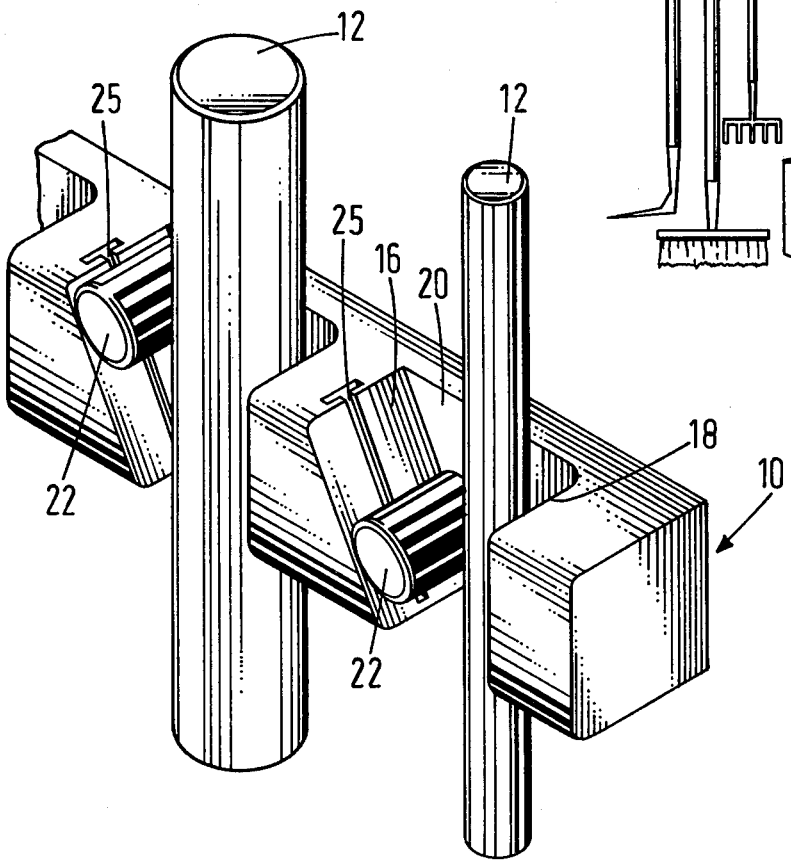
FIG. 2 is a perspective partial elevation of a tool holder accommodating two shafts of different diameter.
Figure 3:
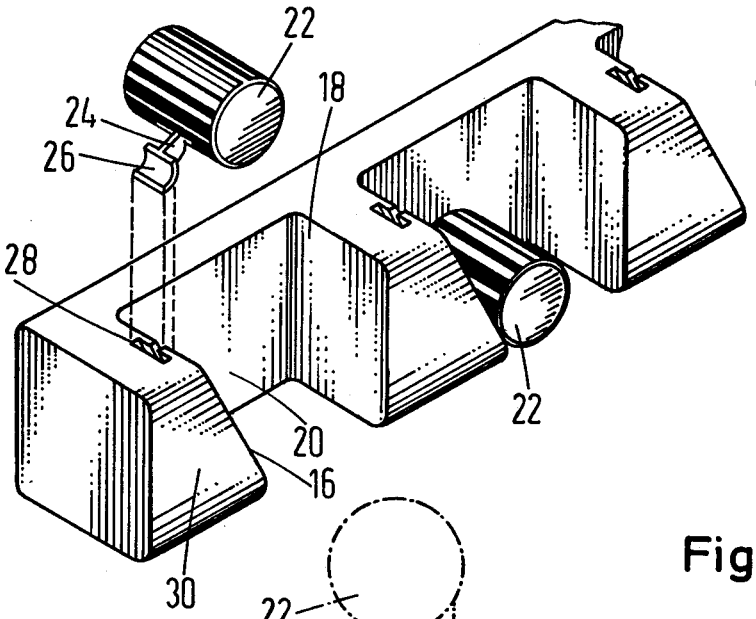
FIG. 3 is a perspective partial elevation of the tool holder shown in FIG. 2 with gripping rollers.

The holder 10 shown in FIGS. 2 and 3 comprises several U-shaped compartments defined by a downwardly sloping side wall 16, a vertical wall 18 opposite this sloping wall 16 and a rear wall 20. The holder is fixed to the wall in such a way that the insertion slot tapers downwards, as can be seen from FIGS. 1, 2, 4 and 5.

Figure 4:
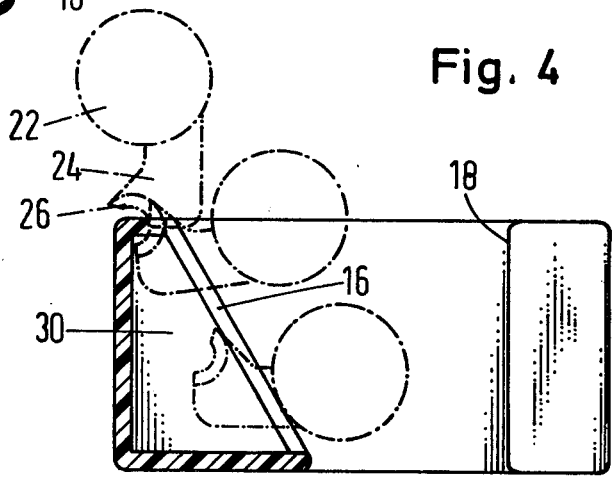
FIG. 4 is a sectional elevation showing the introduction of the roller assembly into the guide slot.

A roller 22 travels along the side wall 16, coming into friction-locking contact with the shaft 12. In order to prevent the roller from dropping out, it is provided with a T-shaped lug of which the longitudinal member 24 fixed to the roller is guided by a slot 25 provided in the sloping wall 16, whilst its transverse member 26 rests on the inside adjacent the slot. In cases where the holder is made of a solid material, the slot guiding the lug 24, 26 also has to be T-shaped. In one preferred embodiment of the invention, however, the holder is injection-moulded from a plastics material, cavities being left between the boundary walls. In this case, only the upper wall of the holder is provided with a transversely extending insertion slot 28 for the transverse member 26 of the lug. As can be seen from FIGS. 4 and 5 in particular, this transversely extending member 26 is formed with a convex curvature to facilitate travel along the inner wall of the sloping surface. The lug 24, 26 is also made of an elastic material, enabling it to be introduced through the slot 28 where, as shown in FIG. 4, the transverse member 26 is slightly bent back and is then snapped into the cavity 30 formed in such a way that the lug cannot readily be removed again in the upward direction.

Figure 5:
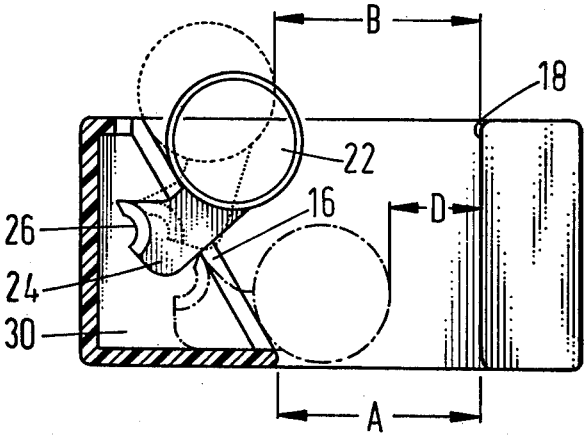
FIG. 5 is a sectional elevation of an individual holder.

In FIG. 5, the position of the roller at the upper end of the sloping surface 16 is shown in chain lines. In this case, the insertion width B for the shaft is equal to the minimum interval A between the two walls 16 and 18 at the lower end of the holder. Shafts as wide as this can still be safely gripped.

FIG. 5 shows the lowermost position of the roller in dash-dot lines, giving a clamping width D which is a measure of the shaft diameter which can still be safely gripped by the holder.

Figure 6:
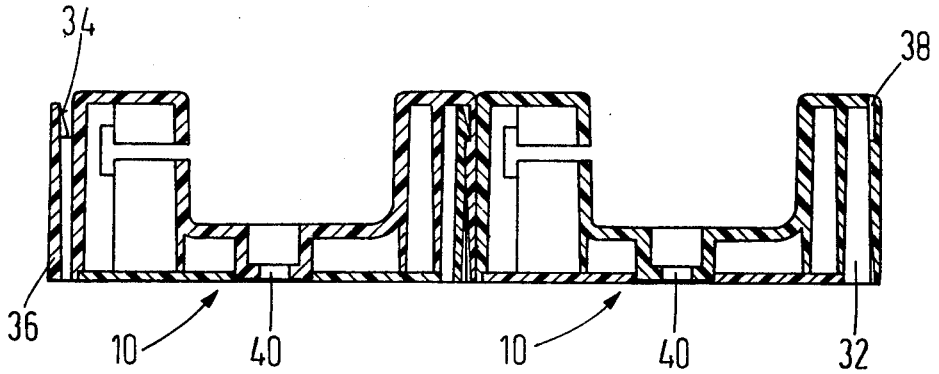
FIG. 6 is a section through two detachably interconnected holders on the line VI—VI of FIG. 7.
Figure 7:
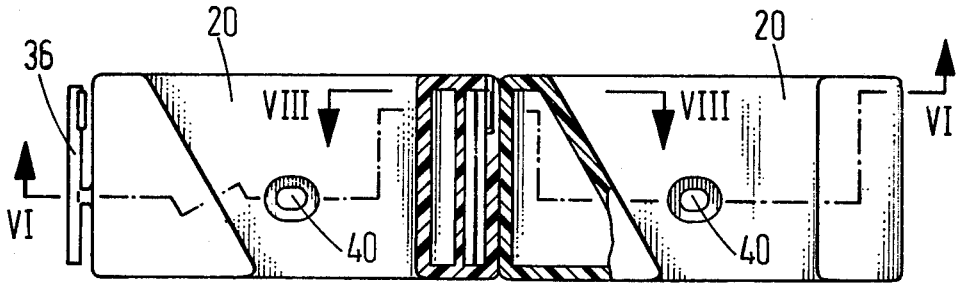
FIG. 7 is a section on the line VII—VII of FIG. 8.
Figure 8:
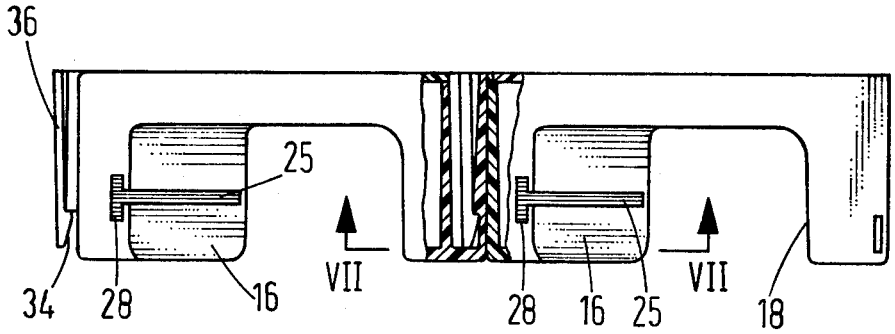
FIG. 8 is a section on the line VIII—VIII of FIG. 7.

FIGS. 6 and 8 show individual holders which may be fitted together to form blocks of any length with any number of holders. To this end, the individual holders 10 are provided on one side with a rearwardly open insertion channel 32 into which a corresponding lug 36 provided with a detent 34 and arranged on the other side of the individual holder is designed to be introduced from the rear. The detent 34 engages in the detent opening 38 so that, after insertion, the two holders are fixed against one another. Fastening holes 40 are provided in the rear wall 20.

Reference will now be made to the embodiment illustrated by way of example in FIGS. 9 to 14.

The guide rail 110, preferably made of a plastics material and having a C-shaped cross-section, is provided with holes 112 which enable it to be screwed to the wall. Instead of this, the rail may also be supplied with an adhesive which enables it to be permanently fixed to smooth wall surfaces. The gripping devices 114 and plates 116 are adapted to be inserted into this rail 110 from the side in order to effect form-locking fixing. The gripping devices 114 are provided with an upper flange 118 and with a lower flange 120 which are gripped by the C-profile so that they are unable to drop out frontwards. The gripping device 114 comprises a wall 122 which is vertical in use and into which friction-increasing elements, in the form of elastomeric gripping bolts 124, are inserted to enhance the gripping effect. The opposite wall 126 is formed with a sloping surface in such a way that the two walls 122 and 126 converge downwards. In a T-shaped slot 128 there engages a correspondingly T-shaped lug of the gripping roller 130 so that, although the gripping roller 130 is able to slide along the wall 126, it remains permanently connected to the gripping device 14. The tool shaft 132 is inserted between the elastomeric gripping bolts 24 and the gripping roller 130 and is automatically gripped under the weight of the tool in conjunction with the wedge effect.

As shown in FIG. 11, the gripping devices 114 are loosely inserted into the rail 110 so that the intervals can be varied as required at any time. In cases where fixed intervals are required, plates corresponding to the plates 116 may be inserted into the rails. As shown in FIGS. 13 and 14, however, these plates 116 may also be provided with fixed hooks 134 or with displaceable S-shaped hooks 136 in order to be able to hold any other, especially relatively small utensils.

In cases where the gripping devices 114 are arranged at an interval from one another, it can be of advantage to affix to the end surfaces adhesive labels 138 or the like which are provided with identification marks or symbols identifying the tool which is to be used.

The ends of the rails 110 may be closed by means of end plugs to prevent the individual elements from sliding out sideways.

The individual gripping devices 114 are best provided with one or more holes (not shown in the drawing) which also enable the elements to be directly fixed to the wall or to a cupboard without the assistance of a guide rail.

The hooks 116 or other fastening elements may of course also be inserted into the rail without gripping devices 114 in between.

I claim:

1. A tool holder, comprising:

a gripping device for a tool shaft or handle, said gripping device being adapted for automatic gripping action due to the weight of the tool; said gripping device comprising:

two opposed side walls between which a tool shaft or handle may be supported; a rear wall joining said side walls and spacing them apart; said side walls and said rear walls defining a frontally open U-shaped portion;

one said side wall having a sloping surface which slopes toward the other said side wall in a plane perpendicular to said rear wall;

a gripping roller resting on said sloping surface and being movable therealong upon engagement therewith by a tool shaft or handle, and said roller coming into friction locking contact with the shaft or handle by wedge effect;

said roller having a T-shaped lug projecting from a side thereof and with respect to which said roller is rotatable; a slot passing through and also extending along said sloping surface parallel to said rear wall; the vertical member of said T-shaped lug passing through said slot; said sloping surface having a back side facing away from said other side wall; the transverse member of said T-shaped lug resting against said sloping surface back side adjacent said slot; said transverse member of said T-shaped lug comprising part of a cylindrical surface having a convex side which rests on said sloping surface back side and which is rollable along said back side upon pivotal motion of said T-shaped lug with respect to said sloping surface.

2. A tool holder as claimed in claim 1, wherein said one side wall includes at the end of said sloping surface furthest from said other wall an upper wall with a slot therein that is shaped to enable said T-shaped lug to pass therethrough; said transverse member of said T-shaped lug being larger in its overall height dimension than the height of the corresponding portion of said upper wall slot through which said transverse member passes and said transverse member being deformable in shape to fit into and to pass said upper wall slot and to thereafter be trapped beneath said upper wall slot in the space in said tool holder at said sloping surface back side.

3. A tool holder as claimed in claim 2, wherein said roller is comprised of rubber.

4. A tool holder as claimed in claim 3, wherein the surface of said roller is knurled.

5. A tool holder as claimed in claim 1, wherein said gripping device rear wall has an upwardly projecting support flange on the top side thereof and has a downwardly projecting support flange on the bottom side thereof; said flanges being shaped and positioned for being insertable into a guide rail of C-shaped cross section.

6. A tool holder as claimed in claim 5, further comprising a guide rail having a C-shaped cross section, with overturned edges which are spaced apart so as to receive and support said upwardly and said downwardly projecting flanges in a manner permitting free displacement of said gripping device along said rail;

a plurality of said gripping devices arrayed along and supported for free displacement in said rail.

7. A tool holder as claimed in claim 6, further comprising form locking end stops on said rail for blocking exit of said gripping devices from the end of said C-shaped cross section rails.

8. A tool holder as claimed in claim 6, wherein the said other opposed side wall supports an elastomeric gripping element for holding the tool shaft or handle in opposition to said roller.

9. A tool holder as claimed in claim 8, wherein said elastomeric gripping element comprises a gripping bolt which extends across said other portion wall from the open side of said holder toward said rear wall.

10. A tool holder as claimed in claim 1, wherein the said other opposed side wall supports an elastomeric gripping bolt for holding the tool shaft or handle in opposition to said roller.

11. A tool holder as claimed in claim 10, wherein said gripping bolt extends across said other side wall from the open portion of said holder toward said rear wall.

* * * * *